US008798921B2

(12) United States Patent
Zink et al.

(10) Patent No.: US 8,798,921 B2
(45) Date of Patent: Aug. 5, 2014

(54) METHOD AND DEVICE FORE REPRODUCING INFORMATION

(75) Inventors: Alexander Zink, Stegaurach (DE); Olaf Korte, Igensdorf (DE); Detlev Von Braumuller, Neuotting (DE); Heinz Gerhauser, Waischenfeld (DE); Roland Plankenbühler, Nuremberg (DE)

(73) Assignee: Fraunhofer-Gesellschaft zur Foerderung der Angewandten Forschung E. V., Munich (DE)

( * ) Notice: Subject to any disclaimer, the term of this patent is extended or adjusted under 35 U.S.C. 154(b) by 1598 days.

(21) Appl. No.: 10/362,669

(22) PCT Filed: Aug. 14, 2001

(86) PCT No.: PCT/EP01/09399

§ 371 (c)(1),
(2), (4) Date: Nov. 6, 2003

(87) PCT Pub. No.: WO02/15147

PCT Pub. Date: Feb. 21, 2002

(65) Prior Publication Data

US 2004/0107046 A1 Jun. 3, 2004

(30) Foreign Application Priority Data

Aug. 14, 2000 (DE) ..... 100 39 663

(51) Int. Cl.
*G01C 21/00* (2006.01)

(52) U.S. Cl.
USPC ..... 701/452; 701/408; 701/420; 701/425; 701/430; 701/451

(58) Field of Classification Search
USPC ..... 701/207, 209, 31; 340/988, 995.16; 712/227; 714/25, 42, 47, 52, 54; 718/102, 103, 107
See application file for complete search history.

(56) References Cited

U.S. PATENT DOCUMENTS

| | | | | |
|---|---|---|---|---|
| 4,142,243 | A * | 2/1979 | Bishop et al. | 714/37 |
| 4,251,885 | A * | 2/1981 | Dodt et al. | 714/50 |
| 4,354,230 | A * | 10/1982 | Murphy et al. | 712/1 |
| 6,085,148 | A | 7/2000 | Jamison et al. | 701/211 |
| 6,085,215 | A * | 7/2000 | Ramakrishnan et al. | 718/102 |
| 6,496,946 | B2 * | 12/2002 | Bannatyne et al. | 714/25 |
| 6,829,475 | B1 * | 12/2004 | Lee et al. | 455/419 |
| 6,834,386 | B1 * | 12/2004 | Douceur et al. | 718/107 |
| 6,904,360 | B2 * | 6/2005 | Pechatnikov et al. | 701/208 |

(Continued)

FOREIGN PATENT DOCUMENTS

| | | | |
|---|---|---|---|
| DE | 69310938 | 4/1993 | G09B 29/10 |
| DE | 19747745 | 10/1997 | G09B 5/04 |

(Continued)

*Primary Examiner* — Bhavesh V Amin

(74) *Attorney, Agent, or Firm* — Michael A. Glenn; Perkins Coie LLP

(57) ABSTRACT

A system for presenting information regarding an object provided within a plurality of information sources to a user or a presentation means depending on a location of the user or the presentation means includes a means for determining the location, a means for selecting the information to be presented depending on the determined location and on one or several pre-settable selection criteria defining an information source from the plurality of information sources, and a means for outputting the information to be presented.

21 Claims, 7 Drawing Sheets

(56) References Cited

U.S. PATENT DOCUMENTS

| | | | | |
|---|---|---|---|---|
| 2002/0046084 | A1* | 4/2002 | Steele et al. | 705/14 |
| 2003/0014379 | A1* | 1/2003 | Saias et al. | 706/45 |
| 2003/0222820 | A1* | 12/2003 | Karr et al. | 342/457 |
| 2004/0111742 | A1* | 6/2004 | Hendricks et al. | 725/34 |
| 2004/0264442 | A1* | 12/2004 | Kubler et al. | 370/352 |
| 2005/0004978 | A1* | 1/2005 | Reed et al. | 709/203 |
| 2005/0015360 | A1* | 1/2005 | Cras et al. | 707/2 |
| 2005/0039177 | A1* | 2/2005 | Burke | 717/165 |

FOREIGN PATENT DOCUMENTS

| | | | | |
|---|---|---|---|---|
| DE | 19810173 | | 3/1998 | G01C 21/14 |
| EP | 0725504 | | 12/1995 | H04H 1/00 |
| EP | 0785535 | | 10/1996 | G08G 1/0968 |
| EP | 0 785 535 | A1 | 7/1997 | |
| JP | 2001-227402 | A | 8/2001 | |
| WO | 96/42145 | | 12/1996 | H04H 1/00 |
| WO | 99/16036 | | 4/1999 | G09B 5/06 |
| WO | WO 99/51017 | | 10/1999 | |

* cited by examiner

```
UMIS Object Information File
Version = 1.0

      this document belongs to an ObjectElement of [...]
      'Universal Mobile Information System' and [...]
      describes the ObjectElement's properties

Title          =   <ANY TITLE>
Description    =   <ANY DESCRIPTION TEXT.\n[...]
                   LINE FOLDINGS ARE POSSIBLE>
Address        =   SAMPLE STREET 1a\nD-12345[...]
                   SAMPLE TOWN\n[...]
                   TEL: 0900/012345\n[...]
                   FAX: 0900/012345\n[...]
                   E-MAIL:INFO@TITEL.DE

Category       =   BUILDING \nCHURCH \nBAROQUE
Position       =   (49° 48' 49.4252" N; [...]
                   11° 13' 19.5038" E), [...]
                   (49.323°W2.123'S)
Importance     =   100
MaxRepetitions =   1

MediaFolder    =   <ANY ABSOLUTE/RELATIVE [...]
                   FOLDER-NAME>
SoundFileName  =   AUDIO-FILE.MP3
SoundFileSize  =   3123123
HTMLFileName   =   HTML-FILE.html
NoInterruption =   1

—END—
```

Fig. 1B

METHOD AND DEVICE FORE REPRODUCING INFORMATION

BACKGROUND OF THE INVENTION

1. Field of the Invention

The present invention relates to the presentation of information regarding an object and in particular to the location-dependent presentation of information, of such as location-dependent information to a car driver.

2. Description of Prior Art

Today, navigation systems are known, wherein a user enters a destination and is led to this destination by the navigation system. In the background such navigation systems are mostly based on proprietary and system specific vector cards, respectively. Although the primary task of these navigation systems is leading the user to the destination, there are also navigation systems providing additional information for individual objects, such as the locations of petrol stations. With these systems, the allocation of such additional information to the individual objects and/or their positioning is based on the representation within the proprietary vector card data. A simple extension by new objects by the user or a third party is therefore very costly and time consuming without knowing the encoding of the card material.

DE 19747745 A1 describes an interactive guidance system for museums or exhibitions. FIG. 5 shows a schematical diagram for illustrating this system. A position determination means 10 is used in order to determine the location of a visitor in the museum. A data base 20 is provided in order to provide information 20*a*, 20*b*, 20*c*, 20*d*, 20*e*, and 20*f*, respectively, for each object (exhibit) within the museum at the positions A, B, C, D, E, F, respectively. The information 20*a*-20*f* for the different exhibits is subdivided into information aspects, like e.g. the epoch, the artist, the interpretation and the materials used for the exhibit, and is graded according to the level of the required knowledge of the museum visitor. The system monitors the reactions of the museum visitor to the hitherto presented information for the exhibits and uses the detected reactions for determining the knowledge of the museum visitor and the information aspects preferred by the visitor using a learning algorithm. The learning algorithm then causes the information aspects of the respective exhibit to be presented to the museum visitor after a certain learning period, which corresponds to the determined preferences, i.e. considering the determined knowledge.

It is a disadvantage of this system that it only comprises a physically limited application area, such as a museum or a city. Additionally, the information is only provided by one information source, which only provides information of a special kind. A user is further not able to add additional information, but this is reserved to the operator of the guidance system, such as the museum.

DE 19810173 A1 refers to a navigation system for vehicles comprising a data basis preferably available in the form of a data base and comprising a device for determining a location and a destination, wherein using the location and the destination and using the road information stored in the data basis a driving route may be calculated. The complete route planning is based on one data basis, in which the road network is stored relating to a few number of points. The selected points are stored within the site data basis. For each point only its position and its distance to other points and the information whether it is a crossing point is stored. The driver of the vehicle is informed about the driving routes using a concatenated list of these points stored within the site data basis.

SUMMARY OF THE INVENTION

It is the object of the present invention to provide an improved system for presenting information regarding an object, which are provided within a plurality of information sources, to a user or a presentation means depending on a location of the user or the presentation means, which does not comprise the restrictions of the user in connection with the available information.

In accordance with a first aspect of the invention this object is achieved by method for presenting information regarding an object from a plurality of information provided within a plurality of information sources to a user or a presentation means depending on a location of the user or the presentation means. The method comprises determining the location, selecting a management part from a plurality of management parts, each of which comprises a reference to one of the plurality of information sources, a position indication and one or several pre-settable selection criteria, depending on the determined location and on the one or the several pre-settable selection criteria of the plurality of management parts, and outputting the information provided within the information source which the reference of the selected management part refers to. The selection criteria of the plurality of information sources includes a category and a weighting value is associate-able to each category of the plurality of management parts, wherein the categories are organised in a tree structure and wherein a weighting is determined based on the weightings within the tree structure and wherein the step of selecting comprises the selection of a management part from the plurality of management parts depending on the weightings of the plurality of management parts In accordance with a second aspect of the invention this object is achieved by device for presenting information regarding an object from a plurality of information, provided within a plurality of information sources to a user or a presentation means depending on a location of the user or the presentation means. The device comprises a location detection device for determining the location. Furthermore a processor for selecting a management part from a plurality of management parts is provided each of which comprises a reference to one of the plurality of information sources, a position indication and one or several pre-settable selection criteria, depending on the determined location and on the one or several pre-settable selection criteria of the plurality of management parts. An information outputting device outputs the information provided within the information source which the reference of the selected management part refers to. The selection criteria of the plurality of information sources includes a category and each category of the plurality of management parts may be associated with a weighting value and wherein the categories are organised in a tree structure, wherein a weighting is determined based on the weightings within the tree structure, and wherein the step of selecting comprises a selection of a management part from the plurality of management parts depending on the weightings of the plurality of management parts.

According to one embodiment the selection criteria for the object, its position specification and if applicable the indication to a desired information source are filed within a management part, wherein the selection criteria include a category and similar things. The information source is either an external information source, for example a broadcasting station or an internet address, which is accessed via corresponding transfer media, or an internal data source, for example data on CDs within a car, wherein the reference specification within the management part refers to one or several external or internal information sources in which the desired information regarding the objects are filed. The category indicates the type of the object for which information is to be presented (e.g. nature, music, etc.).

According to one preferred embodiment, a plurality of weighted hierarchically structured categories may be set weightedly within the selection criteria so that for one location whose position was determined the information about an object is output whose categories comprise the highest weighting within the category hierarchy.

In order to simplify processing, such as extending the available information, all object-relevant indications are filed within the management part. The management part contains selection criteria, i.e. indications about the category to which the information is allocated, about the reference to the information source and about the position. The management part may contain additional indications within the selection criteria, e.g. the relative importance of the information or the maximum desired repeatability of the same. According to one embodiment an author writes the management part for a plurality of desired information in any order into an ASCII file using a predetermined syntax. Hereby the user is allowed an easy processing of the management part even during run time. Additionally, pre-settable selection parameters may be provided, for example in order to define the relation between the position associated with an information and the determined location of the user, which needs to be met in order to cause the selection of the corresponding information, such as a maximum distance between the filed position and the actual location. For example, only information are then output to the user referring to a position which comprises a pre-settable relation to the determined location of the user and which additionally comprised the relatively highest weighting. It is an advantage of the invention that the management part may be created/changed also by a user of the system due to its simple construction.

It is an advantage of the present invention that the area of use of a system which realizes the inventive method and the inventive device is not limited, i.e. it may be used outside as well as within rooms, wherein the extension of the application area is almost unlimited. The system is further not limited to certain fields, such as tourism. Tourist as well as historic information may, for example, be represented by a completely freely hierarchically structured categorization of information as well as by locations of an enterprise or by locally relevant pieces of music. In particular, the free categorization facilitates that the user has more freedom in subdividing information. Compared to the known guidance system, it is possible to add further information sources, for example data bases, in order to increase the information range. Additionally, the already present information may be initialised at the beginning and further information may be added during runtime. Apart from that, the type of provision of the management part is freely selectable. The storage of information within internal information sources on data carriers (for example CDs or Cassettes, exchangeable electronic read-only memories or firmly anchored within a preconfigured overall system) is possible, for example, wherein the associated management parts may also be stored on the data carriers or be associated with the same, whereby an information unit consisting of the information part (internal information source) and management part is formed. The information may also come from external information sources, from which data is transmitted via wireless or wire-bonded media, computer networks or broadcasting systems (for example the DAB). In this case an information unit is formed from the information part (external information source) and the management part. The management part is stored during the system run. The system can at any time be supplemented by further management parts. Further, other external and internal information sources may be determined within the information part of the information unit.

It is an advantage of the invention that a rearrangement, a change or a completion of the management parts by the user is easily possible at any time.

Additionally, the system needs no proprietary illustration format for position indication Instead a geographic standard coordinate system may be used. The system may work with both two-dimensional and three-dimensional coordinate values.

In contrast to the known guidance system, according to the present invention, the weighting of the categories may at be performed at any time, with immediate effect. This way, a costly and time consuming learning process is omitted, so that the system complexity is reduced. Also, a transition time during which the guidance system has adjusted to a change in user preferences is avoided. Apart from that, the present invention is not restricted to the information content of an individual data base but can rather access all available multimedia data, such as the internet, radio broadcasting, CDs.

In contrast to the known guidance system, a user of the inventive system is not restricted concerning the selection of information aspects regarding an exhibit. The problems related to inflexbility and slow adaptation of the guidance system are prevented.

BRIEF DESCRIPTION OF THE DRAWINGS

In the following, preferred embodiments of the present invention are described referring to the accompanying drawings, in which:

FIG. 1B shows an example for a management part of an information unit which is used according to one embodiment of the invention for the selection of information and for the indication of the information sources;

DESCRIPTION OF PREFERRED EMBODIMENTS OF THE INVENTION

Figure 1A:
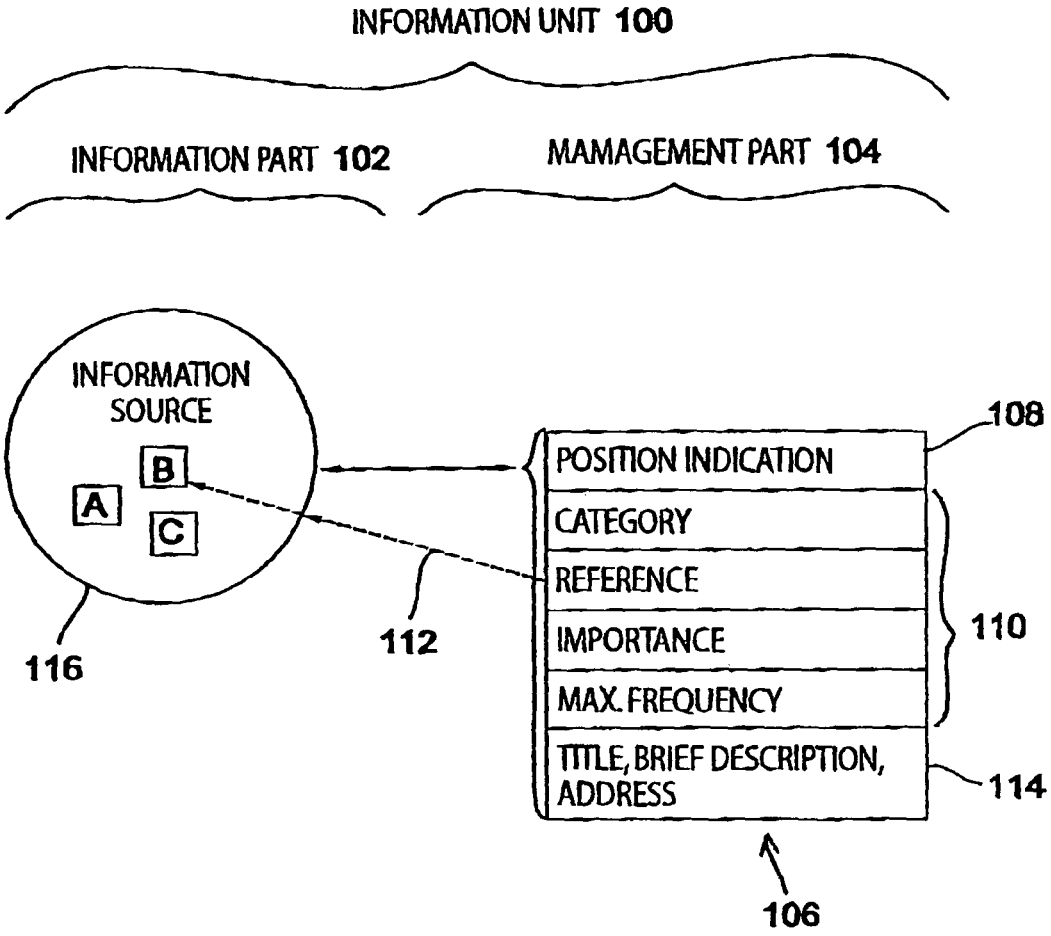
FIG. 1A shows a schematic illustration of an information unit, which is used according to one embodiment of the invention for the selection of information and for the indication of the information sources.

FIG. 1A shows the construction of an information unit 100, including an information part 102 and a management part 104. The management part 102 consists of a list 106 of indications comprising a plurality of selection criteria 110 next to the position 108 in the illustrated embodiment, including a category, a reference to the information source as it is illustrated by the dashed arrow 112, an indication of the relative importance of the information and an indication of how often, at maximum, the information may be presented within a predetermined period of time. The given selection criteria are only exemplary. Depending on the area of use of the system, a plurality of other selection criteria may be determined.

Further, a short indication 114 may be stored within the management part, for example containing a title and a short description of the object (e.g. a building), together with an address, for example a postal address or an internet address, via which the user may order/fetch further information concerning the object independent of the system. These indications may optionally be used as a replacement for external information sources.

The management part may contain a reference to general information sources (CDs with background music, broadcasting stations), which are accessed when the system cannot determine a position (the car is for example in a tunnel), when no information source is available or no object has been selected for the location, no object-specific information may be output.

The information part 102 includes the at least one information source 116, i.e. the site at which the desired information regarding the object is stored. The information source may be an internal information source which is stored together with the management part 102, e.g. on CDs, hard disk etc. within a car or a PC. The information source may also be an external information source, e.g. data bases, directly referenced files which are accessed via remote connections, internet addresses or radio programs which are arranged spaced apart from the management part.

In one embodiment it may be the case that a position of a location may not be determined as a car is, for example, located within a tunnel or no information objects are available for the determined location of the user according to the geographical selection criteria (position). For this case, objects containing no location indication within their management part (position), e.g. break music, location-independent background information, may be defined. The selection is then made from this group of objects.

Using FIG. 1B, an example for a management part is described in more detail in the following.

For the creation of a management part, also called an object description file, general rules apply. These are:

- Empty lines are ignored.
- Comment lines start with the character ";", "#", or with a space character.
- Mutated vowels and special characters are encoded according to the ANSI character set "Western", (i.e.: ISO 8859/1).
- Space characters within texts are admissible.
- Data field designators ("title", "description", "address" etc.) need to be placed at the beginning of a text line; Capitalization is not differentiated.
- Data field designators and data are separated by a "="; any number of space characters before and after the "=" are admissible.
- All data of a data field must be in one line;
- Line breaks within a data field are not admissible.
- Line breaks for outputting a character chain are encoded by "\n".
- Example: Description=line 1\nline 2\nline 3
- For the differentiation of control characters the "backslash"-character"\" must be written as "\\".

A valid object description file must additionally have the following characteristics:

- The file name must have the ending ".umi"; capitalization is not differentiated.
- The first valid data line (without comments and empty lines) of the object description file must contain the text "UMIS Object Information File"; The correct capitalization is to be obeyed!
- The first valid data line (without comments and empty lines) needs to contain the text "---END---"; correct capitalization is to be obeyed!
- The data field "version" (at any place within the file) needs to have the character chain "1.0" for the present first implementation of UM/S. 2

In the following, a short description of the purpose of each data field is given. Additionally, the individual rules which apply for certain data fields are illustrated.

Title

- This data field serves indicate a short title for the respective object.
- The above described general rules for the encoding of mutated vowels apply.
- Control characters for the line folding during output ("\n") are technically possible, their use in the title is however not advisable.

Description

- Here, a detailed description of the object may be given. The use of important key words is to be observed, as this field together with the data fields "title" and "address" is evaluated for a planned search function on all detected objects.
- The general rules for the encoding of mutated vowels and line spacings apply.

Address

- This data set is to give the user the capability of independently obtaining further information about the present object. This may, for, example be achieved by indicating the complete postal address or an internet address.
- The general rules for the encoding of mutated vowels and line spacings apply.

Category

- Each object must be associated with a unique path through the category hierarchy. At least one category stage is to be indicated.
- The general rules for the encoding of mutated vowels apply.
- Empty spacings within category names are admissible.
- The hierarchy levels are separated from each other by the character chain "\n". The indication of the code for displaying a line folding within a category name (also "\n") is therefore not possible.
- Empty spacings around the hierarchy separation code ("\n") are ignored.
- The depth of the used hierarchy levels may differ from object to object.
- As the internal category tree is built up dynamically using this data field, homophonic writing is to be obeyed ("Laub-Baum" is a different category to "Laub-baum")!
- Example: Category=Top-Cat.-Name \n Cat.-Name \n sub-Cat.-Name Position

- The indication of the position is given in geographical standard coordinates (degree of longitude and latitude).
- Any number of position indications for an object may be entered. Each additional position indication internally generates a unique object.

A position indication must be enclosed by round parantheses. Separation characters between the parenthetic expressions are optional and arbitrary.

Each coordinate consists of the parts arc degree (including "*")+arc minutes (including "")+arc seconds (including "")+an indicator for North ("N") and\or South ("S") or East ("E") and/or West ("W") (in this order).

For each coordinate at least one of the three possible arc measure indications and the associated indicator for the direction must be indicated.

The order of indication of the horizontal and vertical coordinate is optional.

The separation character between the two coordinates is optional and arbitrary.

Each arc measure indication consists of figures and optionally a "." as a decimal separation character. Negative values are not possible.

Added up, the values for degrees, minutes and seconds of each coordinate must not exceed the value of 180.0° (East/West) and/or 90.0° (North/South).

If the indication of a position is omitted or if the special coordinate pair (90*s, 180*w) is included in the list of positions, then the object is detected as a "non-positioned object". These special objects may be always then offered for selection when no objects with a firmly determined position indication are available.

The two valid position indications illustrated in FIG. 1B explain the flexibility of the required writing.

Importance

This value describes the relative importance of the objects in relation to the other available objects.

Objects with a higher importance are preferably selected.

The indication requires an integer positive value and should not exceed 10.000.

If a definition of importance is omitted, the default value of 1 is assumed.

MaxRepetition

This data field defines a maximum admissible number of repetitions for the object.

The indication requires an integer positive value and should not exceed 10.000.

The indication 0 stands for an unlimited number of possible repetitions.

If a definition of the maximum repetition number is omitted, the standard value of 0 is assumed.

MediaFolder

The mediaFolder describes the folder in which the following audio and HTML pages are filed.

The indication of the folder may be absolute (e.g. "C:\Media Folder" or \\computerX\disk1\folderABC) or relative to the present folder in which the object description file is located (e.g. "../../Media2")

If an indication is omitted or if the indicated folder cannot be found, then the folder in which the object description file is located is used.

SoundFileName

This is the file name of the audio file, which is to be presented with a successful selection of objects.

If an indication is omitted or if the indicated file cannot be found, an attempt will be made to find the default audio file "content.mp3".

First of all, it is determined whether the indicator is a valid URL. If not, it is determined whether the file name includes a complete path within the local (network) file system and whether this file exists. If not, the file is searched for within the folder specified by the indication MediaFolder. After that, the directory is examined in which the object description file itself is located.

SoundFileSize

This indication informs the system about the size of the audio file in bytes.

This indication is provided in order to ensure the complete reception of audio data during the time specified the system. In the present implementation it is, however, not evaluated and may therefore be omitted.

HTMLFileName

This is the file name of the HTML file, which is to be indicated with a successful selection of the object.

If an indication is omitted or if the indicated file cannot be found, it is tried to find the standard HTML file "index.html".

The same rules apply for the search of this file as well as the SoundFileName.

NoInterruption

By indicating the value "1", the interruption of the presentation of the object is forbidden (practical with "non positioned objects").

If no indication is performed or if a value unequal "1" is entered, the user definable defaults for the interruptability of "unpositioned objects" apply.

This data field is for example provided for the case that the author wants to prevent interruption of presentation of general information about a region.

For each object to be detected by UMTS during system start-up, an object description file needs to be created. In the conception of the used file format special emphasis was put on the simple creatability of the files. Both the generation of a file as well as the gaining knowledge the contents of a file should be possible without proprietary utilities.

Through the separation of the object descriptions—each object has its individual description file—the possibility for an easy exchange and an uncomplicated rearrangement of objects with regard to a project is allowed. Apart from that, during the runtime of the system, new objects may be received, evaluated and added to the internal structures without problem.

Further, the combination possibilities of the description files, objects and multimedia data are to be emphasized: each description file may contain several positions and therefore individual objects. At the same time several object description files may share the same multimedia contents through the separation of description file and contents.

Figure 2:
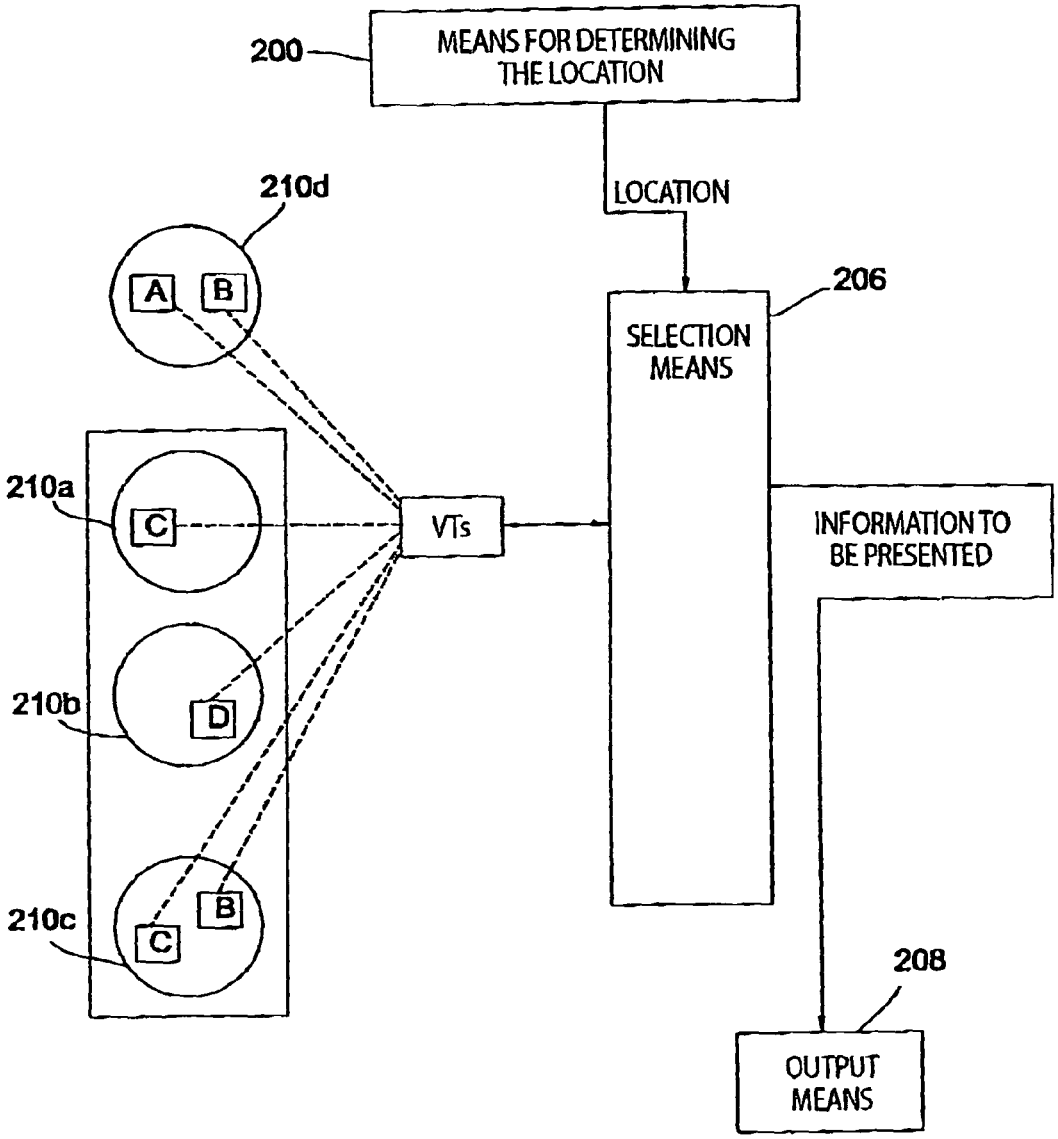
FIG. 2 shows a first embodiment of an inventive device for the presentation of information.

In FIG. 2 a first embodiment of an inventive device for a presentation of information is described.

The device includes a position determination means 200, such as a GPS receiver, a memory 202 storing a management part or a plurality of management parts VTs (FIG. 1A), wherein editing of the selection criteria within the management parts, or adding or deleting management parts by the user is possible, as it is indicated by arrow 204, a selection means 206 and an output means 208. The position determination means 200 is connected to the selection means 206 and delivers information to the same regarding the geographical location. An output of the selection means 206 is connected to an input of the output means 208 in order to output the information to be presented to the output means 208. Within the memory 202 a plurality of information sources 210*a*, 210*b*, 210*c* are stored containing information about fixed objects A, B, C, D, and E (buildings, restaurants, nature or others) contained within the management parts. It is further illustrated in FIG. 2 that a further information source 210*d* is provided which is not stored within the memory 202. The information source 210*d* is an external information source containing information which is accessed via a corresponding remote transmission depending on the selection criteria.

Instead of the above described configuration of information sources, any combination of external and internal information sources is possible. Further, it is possible to use only internal information sources or only external information sources may be used. In the latter case, substantially only the management parts are stored within the memory.

It is shown as an example in FIG. 2 that the information source 210*a* contains information data regarding object C, the information source 210*b* contains information data regarding object D, the information source 210*c* contains information data regarding the objects C and B and the information source 210*d* contains information data regarding the object A and B.

The information sources 210*a* to 210*d* contain data for the different objects A to D (see e.g. also FIG. 1A at 112). One object may for example be a dome or another famous building in a place, wherein preconfigurable categories are associated with every object A to D in the management part. The object A may for example be associated to the category "music", while the objects B, C and D are associated to the categories "companies", "restaurants" and "theatre". The information source 210*a* for example contains a piece of music.

The criteria for selection of objects from the plurality of information objects reported to the system by the management parts have been pre-set by the user or by the distributor. They may, however, also be changed during the runtime of the device. The user then selects a criterion (arrow 204), e.g. the category, in order to change its weighting. Using the geographical position and depending on the selection criteria, the memory 202 is accessed via the selection means 206 and the corresponding information regarding the object is selected. The information to be presented is output to the output means 208 by the selection means 206.

The position determination means 200 may be any device for determining the geographical position of the user, e.g. a GPS system or a mobile telephone. A specially provided and/or dedicated hardware device or cooperating or integrated software, such as a navigation system may be provided in order to provide the location information in geographical standard coordinates, such as within the Gauss Krüger system, the geographical standard coordinate system or in a NMEA 0183-conforming format in order to provide additional information, such as about the movement direction and the speed of the user. Although the output of the location coordinates within the standard coordinate system is preferred, also other coordinate formats are also possible.

The information may contain video data, image data, audio data or multimedia data, while the management part contains a reference, e.g. internet address or local data references, indicating where the respective information is stored. Within the management part 104, an internet address may be indicated at which an audio file containing the piece of music in an encoded form is provided. In this case, the respective information unit is stored separately on different physical units according to information part and management part. The audio data is stored on an internet server (e.g. information source 210*d*), and the associated internet address is stored within the memory 202. On the other hand, information units different information sources may be stored within the same physical memory. For example, the management parts of all information units may be stored within the memory 202, while the respective information part is stored in any other memory. The information part may be, for example, stored on data carriers, electronic exchangeable read only memories and may be available through the transmission of data through wireless or wire-bound media, such as computer networks or broadcasting systems.

Figure 3:
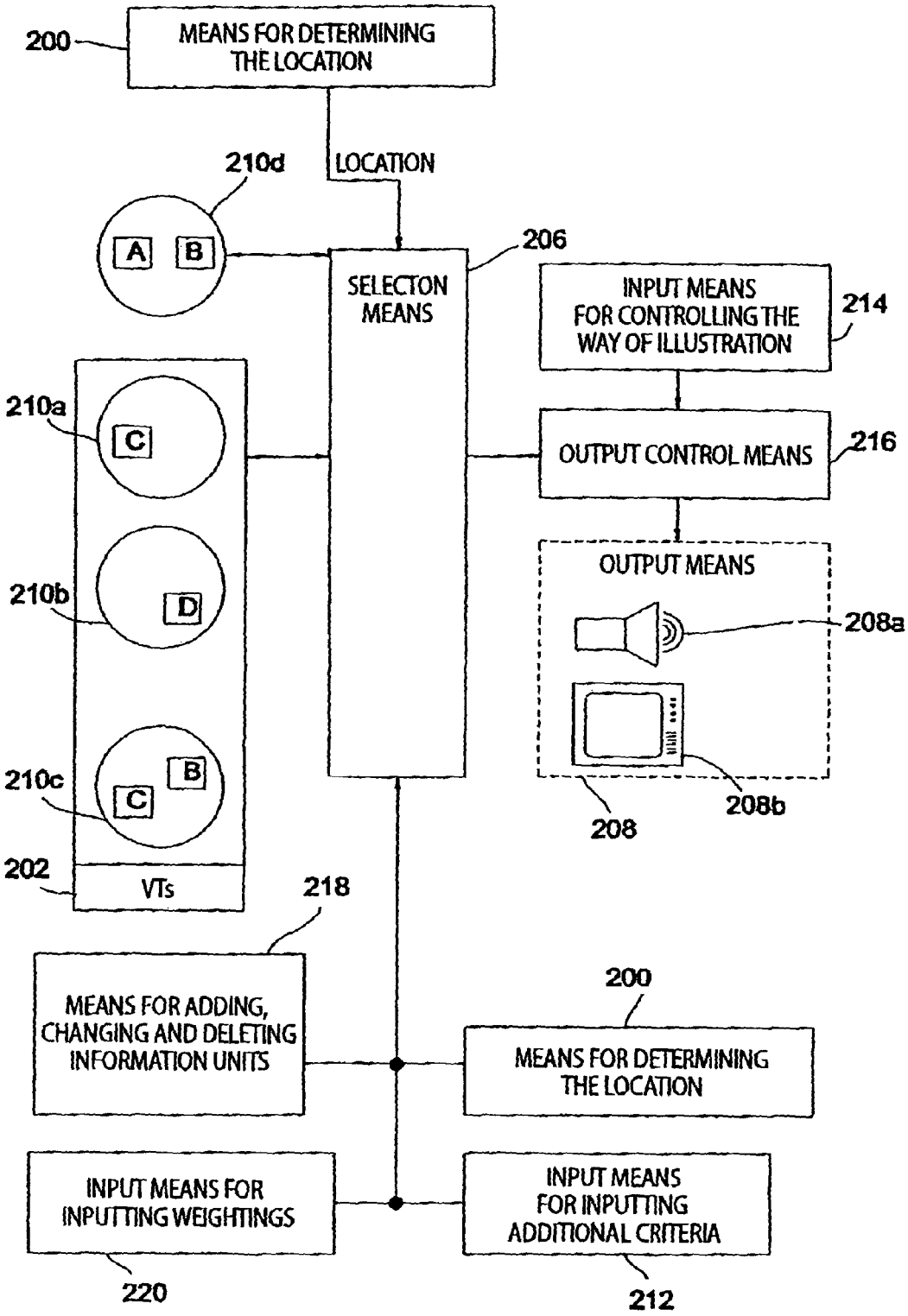
FIG. 3 shows a second embodiment of the inventive device for the presentation of information.
Figure 4:
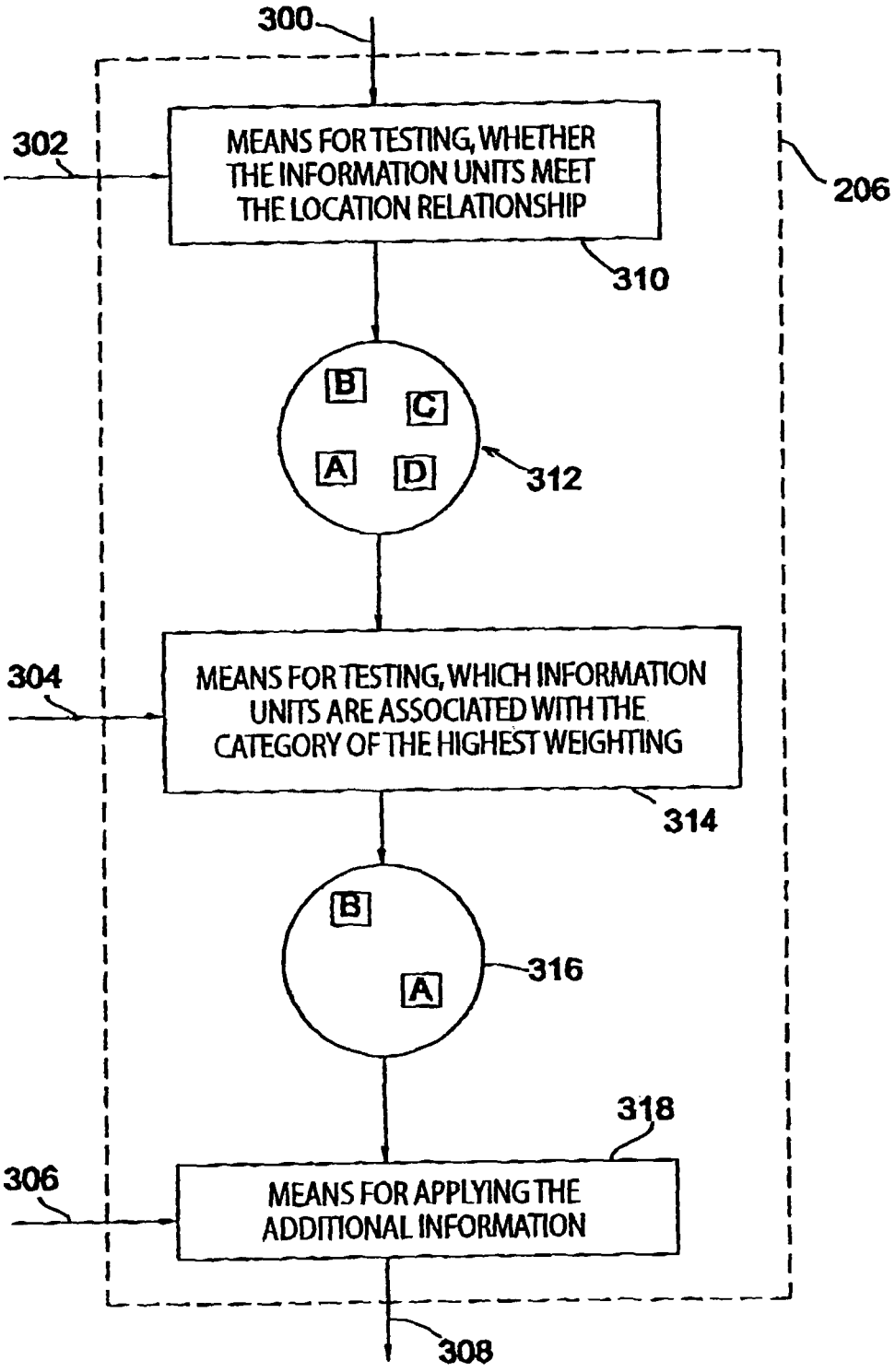
FIG. 4 shows a block diagram for the selection means of the device of FIG. 3.
Figure 5:
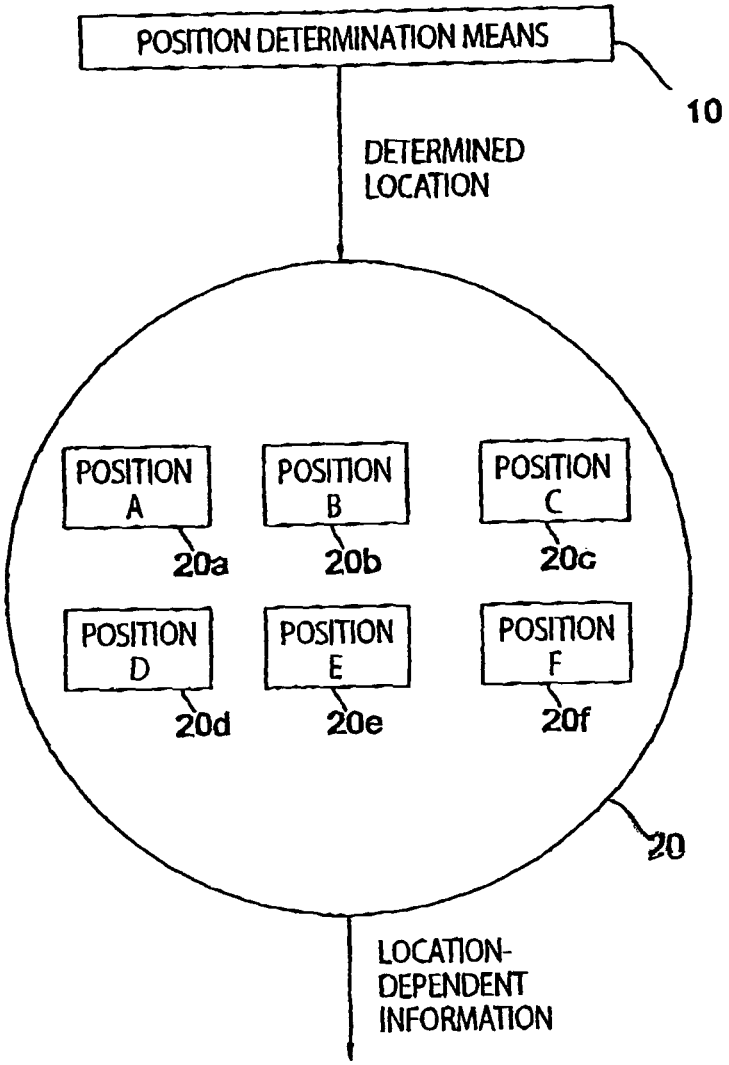
Fig. 5 (PRIOR ART)
FIG. 5 show a guidance system according to the prior art.

In the following description, referring to FIGS. 3 and 4, a further embodiment of the present invention is described, wherein management parts may be modified, deleted or added. In FIGS. 3 and 4 elements previously described in relation to FIG. 2 are designated with like reference numerals.

In contrast to the embodiment illustrated in FIG. 2, the device of FIG. 3 includes an input means 212 for inputting additional criteria, an input means 214 for controlling the type of illustration, an output control means 216, a plurality of output means 208*a* and 208*b*, a means 218 for adding, changing and deleting management parts and/or information parts and an input means 220 for inputting weightings.

The input means 220 for inputting weightings by the user may for example include a keyboard or a voice controller connected to the memory 202 and through which the user is able to change the weightings of the categories.

The input means 212 and 214 for inputting additional criteria and/or for controlling the type of illustration by the user may further include keyboards. The input means 212, 214 and 220 preferably use the same keyboard. The input means 212 is connected to the memory 202, whereas the input means 214 is connected to the output control means 216, which is again connected to the output means 208. The output control means 216 receives the information to be presented at a further input of the selection means 206.

The means 218 for adding, changing and deleting management parts and/or information parts may further include a keyboard through which the user is able to add further selection criteria to the management part of an object (FIG. 1A) and further management parts for new objects within the memory 202. The means 218 may consist of a computer and a suitable data transmission means, such as a data carrier or an infrared interface. The list is stored within the memory 202 accessible for the selection means 206. Through the means 218, the content of the management parts may be completed, changed or reduced. All available management parts are automatically detected when starting the system. If further management parts are added during runtime, these are immediately available for the next selection process.

The operation of the device illustrated in FIG. 3 is now described referring to an example, wherein the device is built into the car of the user. The device 200 is connected to the GPS receiver of the car, wherein the input means 212, 214 and 220 are implemented through a keyboard field at the dashboard or by suitable input devices at the GPS system. A means 218 for adding, changing and deleting information units for example a CD drive may be provided, wherein the user may add new management parts and/or information parts by inserting a CD into the system. The selection means 206 may be implemented as software, firmware or hardware and in particular as a standard processor, an ASIC or a programmable logic circuit.

The information sources 210*a* to 210*d* are for example internet servers, CDs, hard disks, radio stations (analogue, DAB) or other things, wherein suitable devices for accessing the provided information sources may include hard-wired or wireless. An information source (e.g. 210*a*) is for example a CD changer, which is hard wired with the selection means, while the other information sources (e.g. 210*d*) are formed by external data bases coupled to the selection means via a radio connection.

Management parts (104, FIG. 1A), which are stored on a CD-ROM or a hard disk, for example, accessible via the selection means 206 are for example implemented in one embodiment as an ASCII file with a suitable syntax. Through a suitable input at a keyboard of the means 218, the user may add additional management parts and/or information parts as an ASCII file. Special software may be provided, so that the user need not know the special syntax of the ASCII file, but only needs to enter necessary indications of the management part and/or the information part to be added.

The position indication is preferably provided in geographical standard coordinates. The user may select the category, preferably from a list of already existing categories or enter the same as a new category which the system automatically adds to the dynamically generated category tree. The user enters the reference indication in a format which indicates to the selection means 206 where the information is stored. The reference indication may contain implicit indications as to which protocols or decoding algorithms are necessary in order to access the information. Within the management part, however, an additional indication may be provided that indicates how the information part needs to be accessed. The indications about the relative importance and the maximum frequency of information may be entered by the user in order to define an additional order among information of the same category and in order to control, respectively, how often information may be presented within a predetermined period of time.

Figure 6:
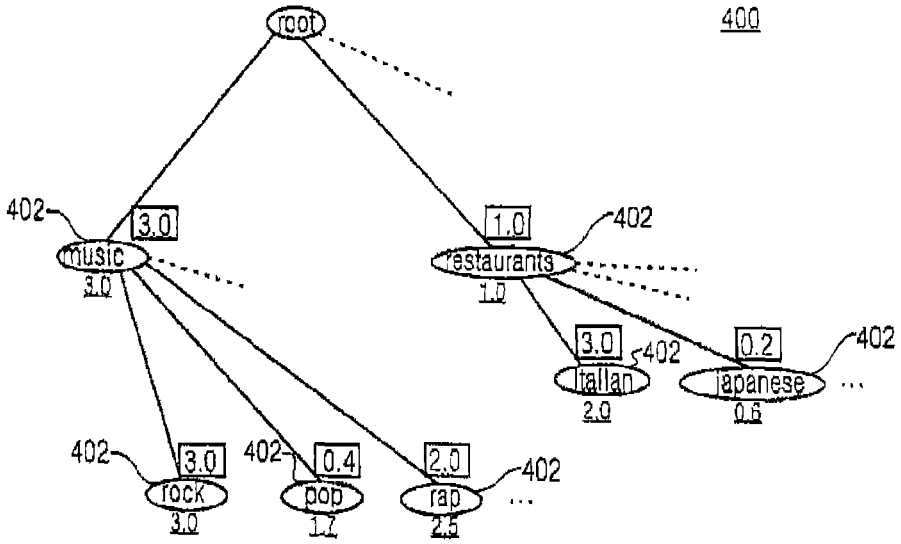
FIG. 6 shows an example for the organization categories in a tree structure in accordance with a preferred embodiment of the present invention.

Via the input means 220 it is possible for the user to determine weightings regarding the existing categories within the hierarchical structure dynamically generated by the system. The categories 402 are for example organised in a tree structure 400 as shown in FIG. 6. In the first level roughly classifying categories are located, like e.g. "music", "restaurants" or similar things. Subcategories of a next level may be present for a category of one level. For the category "music" for example the subcategories "rock", "pop", "rap" or similar things exist, while for the category of "restaurants", the subcategory is "Italian", "Japanese" or similar things exist. The user may allocate a weighting to the categories and subcategories of a tree structure during runtime. Examples of such weighing values are indicated in FIG. 6 within small rectangles neighboring the category or sub-category 402 it is associated with. The weighting of a sub-category may for example be calculated as the average value of all weightings on the way from the root of the tree to the sub-category as it is indicated by the underlined number below each category of sub-category.

Through the input means 212 it is possible for the user to enter additional criteria for the selection means. The user may, for example, specify the relation to the present location needs to be to the location of an object for which information is to be displayed, so that this information is included in a smaller selection. These additional criteria may for example comprise the indication of a minimum and a maximum distance of the present location to the position determined within the management part, so that, for example, only information is output regarding an object which is located in a suitable distance. Additionally, the indication of a minimum and a maximum visual field opening angle may be provided in order to prevent, for example, that information about an object located in a backwards direction is output to the driver. This may be achieved by indicating a maximum and a minimum angle between the connection line through the present location of the user and the object position of the information unit and the direction of movement of the user. Further additional criteria may include indications as to which output means are preferred, so that a car driver may for example specify that only audio information is presented in order not to be distracted from the traffic.

Through the input means 214 the user may turn off certain output means 208*a*, 208*b* of the plurality of output means. If the selection means for example selected an audio file with associated video data, the user may turn off a screen 208*b* in order to have the audio data only output via a loudspeaker 208*a*.

During initialisation the device of FIG. 3, for example during the start-up of the system when starting to drive, the selection means 206 receives access to the stored management parts of the information units, wherein the management parts are updated intermittently. The selection means further receives the determined present location of the user/system and the present direction of movement and the movement speed from the means 200.

Further, the user may receive changed weightings regarding the categories of the input means 220 and the additional criteria of the input means 212. The selection means 206 cyclically scans the management parts within the memory 202 and determines with every run whether information to be presented exists and outputs the same to the output control means. During the run time the management parts may be updated by the means 218 (e.g. also via a continuous reception via DAB, Internet, per radio, etc.), whereby the selection means 206 scans updated management parts in the following cycle. Apart from that, the additional criteria may be changed during runtime.

The above-described settings of the selection criteria using the means 212 to 220 are performed beforehand and may be changed by the above-mentioned means.

In FIG. 4, the selection process within the selection means 206 is described in more detail. The selection means 206 includes four inputs 300, 302, 304, and 306 and one output 308. The selection means further includes a means 310 for determining whether all required location references are met for one object. The means 310 is connected to the input 300 in order to successively receive the management parts of all information units registered within the system. Via the input 302 the means 310 includes the present location of the user and the part of the additional criteria indicating the location reference, i.e. indicating in which relation the present location needs to be with the position indication of an information unit, so that the information of the selection are considered, like e.g. the maximum distance and the indication of the admissible visual field opening angle. The means 310 only selects those objects which meet the location relation (see FIG. 4 at 312). As an example four information blocks are illustrated referring to the objects A, B, C, D, meeting the geographical selection criteria. The information units are let to a testing means 314 detecting a weighted category associated with the information and determining the information comprising the relative highest weighting. The means 314 receives the weighting of the categories for performing the testing through the input 304. The means 314 consequently only advances that information satisfying the location relation and comprising the relative highest weighting. In the present case, this is for example only two information blocks regarding the object A and one of the objects B. The information is supplied to a means 318 for applying additional indications of the management part to the information. The means 318 receives the additional information from the input 306, like e.g. the before-mentioned relative importance of the maximum frequency, and only supplies the information to the output 308 comprising the relatively highest importance and corresponding to the other additional information, respectively.

The information provided at the output 308 is advanced and the output control means 216 distributes the information to be presented according to type to the plurality of output means 208, for example including loudspeakers 208*a* and monitors 208*b*.

The selection means may also scan and process, respectively, the selection of information in parallel, i.e. the processing of the stored management parts. Further, the processing may apply the selection criteria within the management part in any order and extend it by additional criteria.

The present invention provides a system enabling the provision of information concerning object and abstract data, which are connected to a location. The system may work autonomously without being dependent on wireless or wire-bounded data transmission. The description of the objects or the abstract data is performed by the management parts of the information units. The position determination within these management parts may be based on the geographical standard coordinate system.

The system evaluates a position indication provided by external sources. This position indication includes a present location e.g. in geographical standard coordinates and for example an indication of the movement direction and speed for example provided by dedicated hardware or cooperating software.

The objects and abstract data for which information is to be presented are represented by the management part. The management parts include for example a position input in geographical standard coordinates and a hierarchically structured category indication. Further indications within the management part serve to refine the selection process and indication of the information objects. By creating management parts and/or information units, any objects or abstract data may be defined within the information system. The system detects present management parts and/or information parts automatically during system start-up. Further information units may be added during run time. Using the known management parts, the information units and the present location of the user, selection is performed according to geographical criteria, such as the relationship between the present location and the location of the object, and abstract selection criteria, such as the category or the relative importance of the information. The selection criteria are basically freely selectable and may be adjusted in further areas.

The presentation of information is performed by playing audio information and/or illustrating further multimedia contents. The user of the system may influence many parameters of the selection and the illustration during runtime.

One concrete possibility for use of this system is the delivery of information to a driver during while driving, as it was described above other possibilities of use exist, for example with bikers or walkers. On one data carrier, for example, the management parts and the information parts are stored. The system which is, for example, implemented as a notebook server or an integrated part of a car radio has access to present location information, such as for example through the GPS system built in to the car or through dedicated hardware connected to a notebook. If an object, such as a dome, is located in a geographically suitable place, i.e. the relationship between the position of the dome and the present position of the car satisfies a pre-set location relationship, and a weighting of the associated category of the information object, e.g. "sight seeing", is sufficiently high for the selection of this information object and the additional criteria, like e.g. the relative importance or the maximum repeatability are met, then information (data) about the object is presented. When using the system in a car, the selection of audio contents with supplemental graphical and textual information is recommended. The user also has the possibility of modifying the selection process and the way of illustration during the runtime of the system, for example, through a special keyboard within the dashboard of the car.

What is claimed is:

1. A method for presenting a piece of information regarding an object from a plurality of pieces of information provided within a plurality of information sources, to a user or a presentation means, depending on a location of the user or the presentation means, the method comprising the following steps:

determining the location;

selecting a management part from a plurality of management parts, each of which comprises a reference to one of the plurality of information sources, a position indication and one or several pre-settable selection criteria, depending on the determined location and on the one or the several pre-settable selection criteria of the plurality of management parts; and outputting the piece of information provided within the one of the plurality of information sources which the reference of the selected management part refers to, wherein the one or several pre-settable selection criteria of the plurality of information sources include a category, the method further comprising:

associating a weighting value with each category of the plurality of management parts, wherein the categories are organised in a tree structure, determining a weighting of each category based on a combination of the weighting values of some of the categories within the tree structure, wherein the step of selecting comprises the selection of a management part from the plurality of management parts depending on the weightings of the plurality of management parts, and wherein the step of determining the weighting of each category comprises determining the weighting of each category as a mathematical combination of the weighting values of the categories on the way from a root of the tree to the respective category.

2. The method according to claim 1, wherein the reference within the management part refers to one or several information sources in which the desired piece of information regarding the object is filed, wherein the information sources which the reference refers to are an external information source or an internal data source.

3. The method according to claim 2, wherein the category indicates the type of the object.

4. The method according to claim 1, wherein the selection criteria of the plurality of management units include a relative importance and a maximum repeatability.

5. The method according to claim 1, wherein the selection criteria of the plurality of management units further contain an indication of pre-determined data additionally or only enabling the use of the management parts as an information source.

6. The method according to claim 5, wherein the indication contains a title, a brief description of the piece of information which the reference of the management part refers to, and an address via which further information may be ordered/fetched independent of the system.

7. The method according to claim 1, wherein further management parts exist comprising no position indication, wherein the selection criteria of the further management parts comprise a reference to general information sources, and wherein the step of selecting comprises the selection of a further management part if no position may be determined, no information source corresponding to the geographical selection criteria is available or no information regarding an object is to be output for the location.

8. A device for presenting a piece of information regarding an object from a plurality of pieces of information provided within a plurality of information sources, to a user or a presentation means depending on a location of the user or the presentation means, the device comprising:

means for determining the location;

means for selecting a management part from a plurality of management parts, each of which comprises a reference to one of the plurality of information sources, a position indication and one or several pre-settable selection criteria, depending on the determined location and on the one or several pre-settable selection criteria of the plurality of management parts; and means for outputting the piece of information provided within the one of the plurality of information sources which the reference of the selected management part refers to, wherein the one or several pre-settable selection criteria of the plurality of information sources include a category, and wherein the device further comprises:

means for associating a weighting value with each category of the plurality of management parts, wherein the categories are organised in a tree structure, means for determining a weighting of each category based on a combination of the weighting values of some of the categories within the tree structure, wherein the means for selecting is adapted to perform the selection of a management part from the plurality of management parts depending on the weightings of the plurality of management parts, and wherein the weighting of each category is determined as a mathematical combination of the weighting values of the categories on the way from a root of the tree to the respective category.

9. The device according to claim 8, wherein the reference within the management part refers to one or several information sources in which the desired piece of information regarding the object is filed, wherein the information sources which the reference refers to are an external information source or an internal data source.

10. The device according to claim 9, wherein the category indicates the type of the object.

11. The device according to claim 8, wherein the selection criteria of the plurality of management units include a relative importance and a maximum repeatability.

12. The device according to claim 8, wherein the selection criteria of the plurality of management units further contain an indication of predetermined data which additionally or only allow the use of the management parts as an information source.

13. The device according to claim 12, wherein the indication contains a title, a brief description of the piece of information which the reference of the management part refers to, and an address via which further information may be ordered/fetched independent of the system.

14. The device according to claim 8, wherein further management parts exist, comprising no position indication, wherein the selection criteria of the further management parts contain a reference to general information sources, and wherein the step of selecting comprises the selection of a further management part if no position may be determined, no information source corresponding to the geographical selection criteria is available, or no information regarding an object is to be output for the location.

15. The device according to claim 8, wherein the weighting of each category is determined as the average value of the weighting values of the categories on the way from a root of the tree to the respective category.

16. The device according to claim 8, wherein the weighting values are associatable with each category of the plurality of management parts by the user in run time.

17. The method according to claim 1, wherein the step of determining the weighting of each category comprises determining the weighting of each category as the average value of the weighting values of the categories on the way from a root of the tree to the respective category.

18. The method according to claim 1, wherein the step of selecting a management part from the plurality of management parts is performed such that the management part selected is among a set of management parts the position indication of which fulfils a predetermined proximity criterion with respect to the determined location, with the selection among the set of management parts being performed dependent on the weightings of the categories.

19. The method according to claim 1, wherein the weighting values are settable by the user in run time, independent from the position of the categories in the tree structure such that categories linked to a common parent node in the tree structure may have different weightings.

20. The device according to claim 8, wherein the means for selecting is configured to select a management part from the plurality of management parts such that the management part selected is among a set of management parts the position indication of which fulfils a predetermined proximity criterion with respect to the determined location, with the selection among the set of management parts being performed dependent on the weightings of the categories.

21. The device according to claim 8, wherein the weighting values are settable by the user in run time, independent from the position of the categories in the tree structure such that categories linked to a common parent node in the tree structure may have different weightings.

* * * * *

UNITED STATES PATENT AND TRADEMARK OFFICE

CERTIFICATE OF CORRECTION

PATENT NO. : 8,798,921 B2
APPLICATION NO. : 10/362669
DATED : August 5, 2014
INVENTOR(S) : Alexander Zink et al.

It is certified that error appears in the above-identified patent and that said Letters Patent is hereby corrected as shown below:

Title page, Item (54) and in the Specification, Column 1 Title:

METHOD AND DEVICE FORE REPRODUCING INFORMATION
should read:
METHOD AND DEVICE FOR REPRODUCING INFORMATION Title page, Item (75) Inventors:

Detlev von Braumuller
should read:
Detlev von Braumueller

Heinz Gerhauser
should read:
Heinz Gerhaeuser

Title page, Item (73) Assignee:

Fraunhofer-Gesellschaft zur Foerderung der Angewandten Forschung E.V.
should be:
Fraunhofer-Gesellschaft zur Foerderung der angewandten Forschung e.V.

Signed and Sealed this
First Day of March, 2016

Michelle K. Lee

Michelle K. Lee
*Director of the United States Patent and Trademark Office*